US006362441B1

(12) United States Patent
Xie

(10) Patent No.: US 6,362,441 B1
(45) Date of Patent: Mar. 26, 2002

(54) PNEUMATIC FOOT SWITCH ASSEMBLY

(75) Inventor: Mark Mingjun Xie, Tipp City, OH (US)

(73) Assignee: Premark FEG L.L.C., Wilmington, DE (US)

( * ) Notice: Subject to any disclaimer, the term of this patent is extended or adjusted under 35 U.S.C. 154(b) by 0 days.

(21) Appl. No.: 09/539,542

(22) Filed: Mar. 31, 2000

(51) Int. Cl.[7] ..... H01H 3/14; G05G 1/14
(52) U.S. Cl. ..... 200/86.5; 200/81 H; 74/512
(58) Field of Search ..... 74/512, 513; 192/116.5–150; 251/295; 200/81 R–81 H, 86.5, 61.85, 61.86

(56) References Cited

U.S. PATENT DOCUMENTS

| | | | | | |
|---|---|---|---|---|---|
| 595,898 | A | | 12/1897 | Whipple et al. | 200/86.5 X |
| 1,027,702 | A | | 5/1912 | Durand | 74/512 |
| 1,459,317 | A | | 6/1923 | Birdsall | 74/512 X |
| 2,207,700 | A | | 7/1940 | Porter | 74/513 |
| 2,693,716 | A | | 11/1954 | Ludwig | 74/512 |
| 2,928,293 | A | | 3/1960 | Rockwell | 74/512 |
| 4,388,508 | A | | 6/1983 | Wilson | 200/86.5 X |
| 4,487,305 | A | | 12/1984 | Wagner | 192/129 A |
| 4,496,811 | A | * | 1/1985 | Irwin | 200/86.5 |
| 4,639,710 | A | * | 1/1987 | McMillan et al. | 200/86.5 X |
| 4,888,997 | A | | 12/1989 | Eckert et al. | 74/512 X |
| 5,511,763 | A | * | 4/1996 | Green | 251/295 X |

OTHER PUBLICATIONS

Hobart Catalog of Replacement Parts (Jun. 1998).

* cited by examiner

*Primary Examiner*—J. R. Scott
(74) *Attorney, Agent, or Firm*—Thompson Hine LLP

(57) ABSTRACT

A foot actuated pneumatic switch for use in association with food-equipment such as mixer-grinders. The switch includes a u-shaped compressible pedal and a hemispherically shaped rubber actuator. The operator applies pressure to the pedal thereby depressing the actuator and initiating operation of the equipment. The pedal operates by means of a spring-like operation which enables the pedal to return to its static position when the pressure on the pedal is removed.

21 Claims, 3 Drawing Sheets

PNEUMATIC FOOT SWITCH ASSEMBLY

BACKGROUND OF THE INVENTION

1. Technical Field

The present invention relates generally to pneumatic switches, and more particularly, to a foot actuated pneumatic switch assembly for use in association with food equipment such as mixer-grinders.

2. Background Information

Foot actuated pneumatic switches are often used in the food equipment industry to obtain precise hands-free operation of the desired food equipment, such as a meat mixer-grinder. A typical switch employs some type of actuator, such as a hollow rubber hemisphere, that effects initiation or termination of operation of the equipment. When depressed, the actuator creates a burst of pressurized air which passes through a hose, tubing or other path to flip a pressure operated switch thereby initiating operation of a piece of equipment.

Various configurations of such pneumatic switches are known, but as in any industry improved constructions are continually sought.

SUMMARY OF THE INVENTION

The invention provides a switch assembly having a compressible pedal and an actuator. The pedal is u-shaped, consisting of a top and bottom plate which are hinged by a rear panel having a curved shape and acting as a leaf spring. The actuator is a hemispherically shaped rubber component designed to produce a burst of air when depressed. The operator steps upon the top plate of the pedal, thereby depressing the actuator causing a burst of air to be delivered to a switch which may, for example, initiate or terminate operation of a piece of equipment. Upon removing the pressure applied to the top plate, the spring-like action of the rear panel pushes the u-shaped pedal back into its original shape thereby allowing the actuator to regain its normal shape.

DETAILED DESCRIPTION

Figure 1:
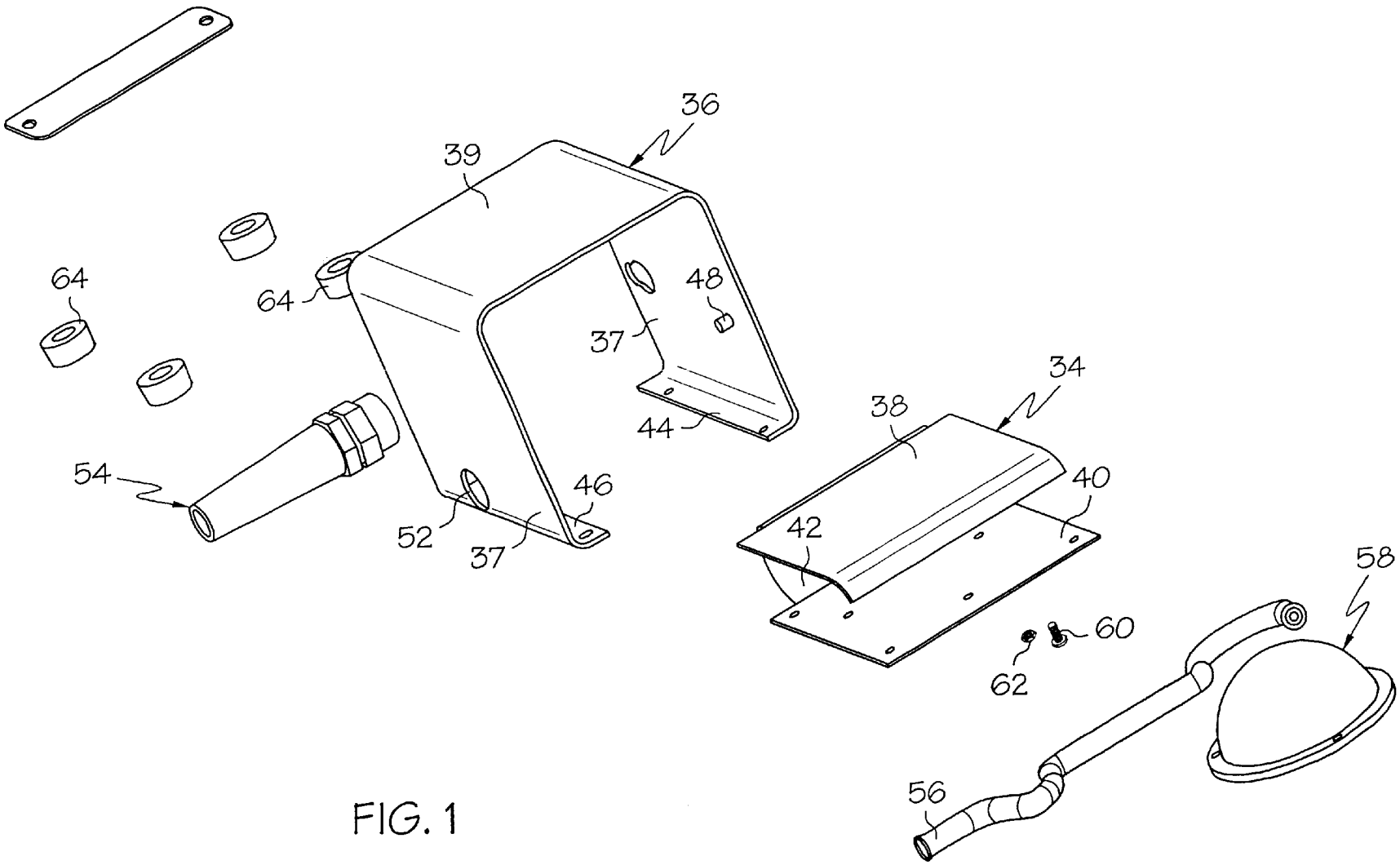
FIG. 1 is a schematic illustration in an exploded state of one presently preferred embodiment of a foot actuated pneumatic switch assembly constructed according to the present invention.
Figure 2:
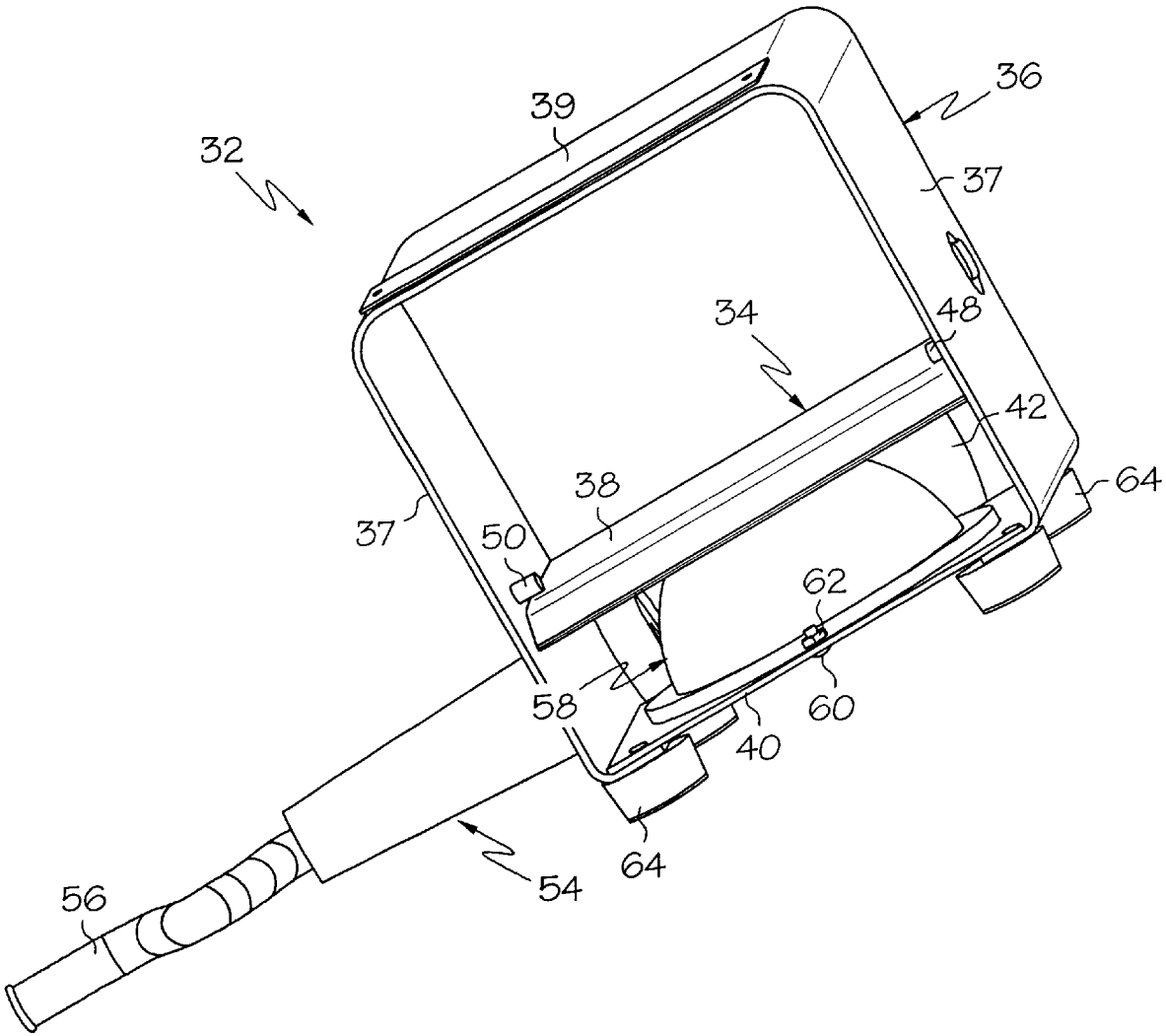
FIG. 2 is a schematic illustration of the foot actuated pneumatic switch assembly of FIG. 1 in assembled form.

A foot actuated pneumatic switch assembly 32 is shown in FIG. 2, with an exploded view shown in FIG. 1. The switch assembly includes a compressible pedal member 34 and a switch housing 36. Compressible pedal member 34 includes an upper plate 38, a lower plate 40, and a rear panel 42 connecting the two plates. Rear panel 42 preferably has a curved shape and provides as a leaf spring type action. A side to side width of the real panel 42 is less than a side to side width of the plates 38 and 40 such that the side edges of the rear panel are spaced from the sides 37 of the housing 36, allowing access to the pedal member 34 interior from the rear of the assembly 32. Pedal member 34 may be formed as a unitary member in which a sheet metal plate is cut and bent to shape. Alternatively the upper plate 38, lower plate 40 and rear panel 42 may be initially formed separately and then connected together using, for example, a welding operation.

Switch housing 36 is formed by a shaped metal plate having two sides 37 and a closed top 39, with an open back and front. The bottom of switch housing 36 is partially open due to two protruding lips 44, 46 which each have two openings designed to match up with the openings on lower metal plate 40 for securing metal plate 40 in a fixed position within switch housing 36 using fasteners (not shown). By securing lower plate 40 in a fixed position within switch housing 36, compressible pedal member 34 becomes operable. Applying downward force to the upper plate 38 of compressible pedal member 34 causes upper plate 38 to move downward towards lower plate 40 as real panel 42 bends. When the pressure is removed, the leaf spring action of rear panel 42 pushes upper plate 38 in an upward direction until it stops in its original position. Protrusions 48, 50 extend from the inner surfaces housing sides 37 to prevent deformation of compressible pedal 36 by inhibiting excessive upward movement of upper plate 38. Similar protrusions could also be provided to limit the downward movement of upper plate 38.

In addition to the features described above, switch housing 36 also has an opening 52 located near the bottom portion of one of the sides 37. This opening 52 receives a protective strain relief member 54 which is manufactured from some rigid material such as plastic and is designed to protect hose 56 from being damaged as it passes from actuator 58 to the exterior of the housing 36. The burst of pressurized air needed to flip a pressure operated switch is generated by actuator 58 which is positioned in the space between the upper plate 38 and lower plate 40.

Figure 3:
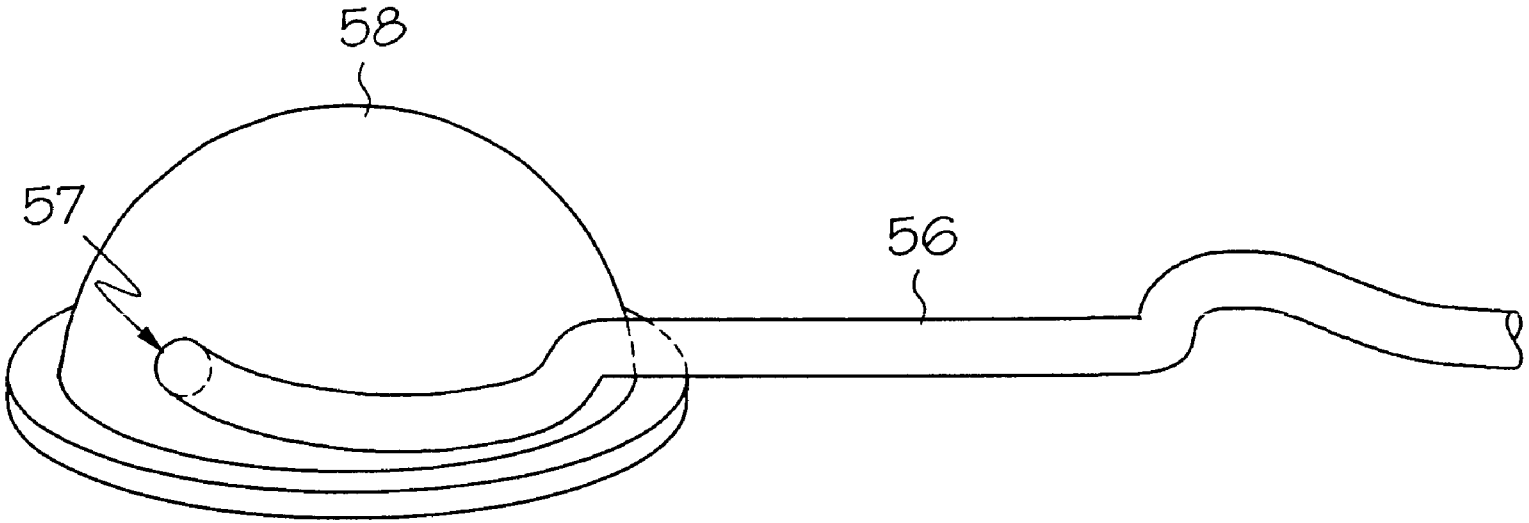
FIG. 3 is a schematic illustration of the rear portion of an actuator and associated tubing of the foot actuated pneumatic switch assembly (strain relief not shown).

The actuator 58 is in the form of a hollow rubber hemisphere having an air outlet 57 (FIG. 3) in the rear portion thereof where hose 56 is connected. When deformed, actuator 58 creates a burst of pressurized air that passes through the air outlet 57 in the back portion of the actuator into hose 56 and ultimately to the pressure operated switch on the desired piece of equipment. Actuator 58 is attached, in a fixed position, to the top portion of lower plate 40 by fasteners 60, 62. From this fixed position within compressible pedal member 34, actuator 58 can be deformed when downward pressure is applied to upper plate 38.

In sum, the user is able to extend a foot through the open front of switch housing 36 onto compressible pedal member 34 for the purpose of applying downward pressure. This downward pressure causes upper plate 38 to move towards lower plate 40 thereby deforming actuator 58. Upon deformation, actuator 58 produces a burst of pressurized air which travels through hose 56 and flips the pressure operated switch thereby initiating or terminating operation of the desired piece of equipment. When the downward pressure is removed, the leaf spring operation of rear panel 42 returns upper plate 38 to its original position allowing actuator 58 to regain its initial form of a hollow rubber hemisphere. This process can be executed repeatedly to turn a desired piece of equipment on or off.

Support feet 62 may also be connected to the switch housing 36 for supporting the assembly 32 as shown.

Although the invention has been described and illustrated in detail it is to be clearly understood that the same is intended by way of illustration and example only and is not intended to be taken by way of limitation. A variety of other modifications which do not depart from the scope and spirit of the invention will be evident to persons of ordinary skill in the art from the disclosure herein. For example, the switch housing may taken on various configurations. Further, the actuator may also take on configurations in addition to that shown. Accordingly, the spirit and scope of the invention are to be limited only by the terms of the appended claims.

What is claimed is:

1. A pneumatic foot switch assembly, comprising:

a pedal member including an upper plate, a lower plate and a rear panel connecting the upper plate to the lower plate, wherein the upper plate is movable toward the lower plate when a force acts downward thereon, the rear panel bending during movement of upper plate toward the lower plate;

an actuator for producing a burst of air when depressed, the actuator including an interior space for containing air and an air outlet for permitting air to exit the interior space when the actuator is depressed, the actuator positioned between the upper plate and the lower plate of the pedal member for being depressed when the upper plate moves downward toward the lower plate.

2. The pneumatic foot switch assembly of claim 1 wherein the rear panel of the pedal member provides a spring-like action between the upper plate and the lower plate for urging the upper plate away from the lower plate to allow the actuator to return to a non-depressed state when the force acting downward upon the upper plate is reduced or removed.

3. The pneumatic foot switch assembly of claim 1 wherein the actuator is hemispherically shaped.

4. The pneumatic foot switch assembly of claim 3 wherein the actuator is comprised of a rubber material.

5. The pneumatic foot switch assembly of claim 1 wherein the upper plate, lower plate and rear panel are formed as a unitary member.

6. The pneumatic foot switch assembly of claim 1, further comprising:

a housing including at least first, and second sides and a top;

wherein the pedal member is secured within the housing such that the upper plate is movable relative to the housing and the lower plate is fixed relative to the housing; and wherein at least a portion of the housing is open for permitting an operator's foot to be positioned on the upper plate of the pedal member.

7. The pneumatic foot switch assembly of claim 6 wherein the housing includes an opening through one of the sides, the opening located near a bottom portion thereof, the assembly further comprising:

a tubing member extending through the opening in the housing and including a first end connected to the air outlet of the actuator for receiving the burst of air therefrom.

8. The pneumatic foot switch assembly of claim 6 wherein an inner surface of at least one side of the housing member includes a projection positioned to limit upward movement of the upper plate of the pedal member.

9. The pneumatic foot switch assembly of claim 1 wherein the actuator is secured to the lower plate of the pedal member by at least one fastener.

10. The pneumatic foot switch assembly of claim 6 wherein a width of the rear panel is less than a width of the upper and lower plates such that side edges of the rear panel are spaced from the first and second sides of the housing.

11. A pneumatic foot switch assembly, comprising:

a foot pedal portion including an upper plate and a lower plate, a rear panel connected with the upper plate for holding the upper plate above the lower plate in a movable manner enabling the upper plate to be moved downward toward the lower plate when a force acts downward thereon, the rear panel providing a spring-like resilience for urging the upper plate away from the lower plate when the force which acts downward upon the upper plate is reduced or removed; and an actuator for producing a burst of air when depressed, the actuator including an interior space for containing air and an air outlet for permitting air to exit the interior space when the actuator is depressed, the actuator positioned between the upper plate and the lower plate for being depressed when the upper plate moves downward toward the lower plate.

12. The pneumatic foot switch assembly of claim 11 wherein the foot pedal portion is formed as a unitary member.

13. The pneumatic foot switch assembly of claim 11, further comprising:

a housing including at least first and second sides and a top;

wherein the upper plate is positioned substantially within the housing and is movable relative to the housing, the lower plate being fixed relative to the housing; and wherein at least a portion of the housing is open for permitting an operator's foot to be positioned on the upper plate of the pedal member.

14. The pneumatic foot switch assembly of claim 11, further comprising:

a housing including at least first and second side and a top;

wherein the upper plate is positioned substantially within the housing and is movable relative to the housing; and wherein an inner surface of at least one side of the housing member includes a projection positioned to limit upward movement of the upper plate of the pedal member.

15. A pneumatic foot switch assembly, comprising:

a substantially u-shaped pedal member including an upper portion, a lower portion and a rear portion connecting the upper portion and the lower portion, wherein the upper portion, lower portion and rear portion define an internal space therebtween, the rear portion providing a spring-like connection between the upper portion and the lower portion allowing the upper portion to move toward the lower portion when a force is exerted downward thereon and urging the upper portion away from the lower portion when the force is removed; and an actuator positioned within the internal space of the u-shaped pedal member and having a non-deformed configuration when in a non-actuated state, the actuator being contacted and deformed by the upper portion when the upper portion moves toward the lower portion, the actuator returning to the non-deformed state when the rear portion urges the upper portion away form the lower portion.

16. The pneumatic foot switch assembly of claim 15 wherein the u-shaped pedal member is a unitary member formed from a sheet metal material.

17. The pneumatic foot switch assembly of claim 15 wherein the actuator includes an internal cavity and an outlet opening in communication with the internal cavity, a volume of the internal cavity when the actuator is in the non-deformed configuration being greater than a volume of the internal cavity when the actuator is deformed between the upper portion and the lower portion of the u-shaped pedal member.

18. The pneumatic foot switch assembly of claim 15 further comprising:

a housing including at least first and second sides and a top;

wherein the u-shaped pedal member is positioned substantially within the housing; and wherein an inner surface of at least one side of the housing member includes a projection positioned to limit upward movement of the upper portion of the pedal member.

19. An apparatus for use in compressing an air actuator, comprising:

a substantially u-shaped pedal member including an upper plate, a lower plate and a rear panel connecting the upper plate and the lower plate, wherein the upper plate, lower plate and rear panel define an internal actuator receiving space therebtween, the rear panel providing a spring-like connection between the upper plate and the lower plate allowing the upper plate to move toward the lower plate when a force is exerted downward thereon and urging the upper plate away from the lower plate when the force is removed.

20. The pedal member of claim 19, further comprising:

a housing including at least first and second sides and a top;

wherein the u-shaped pedal member is positioned substantially within the housing; and wherein an inner surface of at least one side of the housing member includes a projection positioned to limit upward movement of the upper portion of the pedal member.

21. The pedal member of claim 19 wherein at least a portion of the rear panel is curved, the rear panel bending as the upper plate moves toward the lower plate.

* * * * *

UNITED STATES PATENT AND TRADEMARK OFFICE

CERTIFICATE OF CORRECTION

PATENT NO. : 6,362,441 B1
DATED : March 26, 2002
INVENTOR(S) : Mark Mingjun Xie

It is certified that error appears in the above-identified patent and that said Letters Patent is hereby corrected as shown below:

Column 4,
Line 44, the word “therebtween” should be -- therebetween --.
Line 56, the word “form” should be -- from --.

Column 5,
Line 18, the word “therebtween” should be -- therebetween --.

Signed and Sealed this

Fourth Day of June, 2002

*Attest:*

*Attesting Officer*

JAMES E. ROGAN
*Director of the United States Patent and Trademark Office*